US008894383B2

(12) United States Patent
Taguchi

(10) Patent No.: US 8,894,383 B2
(45) Date of Patent: Nov. 25, 2014

(54) RECIPROCATION COMPRESSOR

(75) Inventor: Yukihiko Taguchi, Gunma (JP)

(73) Assignee: Sanden Corporation, Gunma (JP)

( * ) Notice: Subject to any disclaimer, the term of this patent is extended or adjusted under 35 U.S.C. 154(b) by 360 days.

(21) Appl. No.: 13/512,572

(22) PCT Filed: Nov. 19, 2010

(86) PCT No.: PCT/JP2010/006813

§ 371 (c)(1),
(2), (4) Date: May 29, 2012

(87) PCT Pub. No.: WO2011/064976

PCT Pub. Date: Jun. 3, 2011

(65) Prior Publication Data

US 2012/0237371 A1 Sep. 20, 2012

(30) Foreign Application Priority Data

Nov. 27, 2009 (JP) ..... 2009-269470

(51) Int. Cl.
*F04B 1/12* (2006.01)
*F04B 27/18* (2006.01)
*F04B 39/16* (2006.01)

(52) U.S. Cl.
CPC ..... *F04B 27/1804* (2013.01); *F04B 39/16* (2013.01); *F04B 2027/1818* (2013.01); *F04B 2027/1831* (2013.01)
USPC ..... 417/269

(58) Field of Classification Search
CPC ..... F04B 2027/1831; F04B 2027/1818; F04B 27/1804; F04B 39/16
USPC ..... 417/222.2, 269–272
See application file for complete search history.

(56) References Cited

U.S. PATENT DOCUMENTS

| | | | | |
|---|---|---|---|---|
| 5,174,727 | A * | 12/1992 | Terauchi et al. | 417/222.1 |
| 6,099,276 | A * | 8/2000 | Taguchi | 417/569 |
| 6,422,830 | B1 * | 7/2002 | Yamada et al. | 417/222.2 |
| 7,293,965 | B2 * | 11/2007 | Tabuchi et al. | 417/222.2 |
| 8,241,012 | B2 * | 8/2012 | Inoue et al. | 417/269 |

FOREIGN PATENT DOCUMENTS

| | | |
|---|---|---|
| JP | 13458/1979 | 8/1980 |
| JP | 52595/1979 | 11/1980 |
| JP | 10-281060 | 10/1998 |
| JP | 2005-120972 | 5/2005 |

* cited by examiner

*Primary Examiner* — Charles Freay
(74) *Attorney, Agent, or Firm* — Cozen O'Connor

(57) ABSTRACT

[Object of the Invention] An object of the present invention is to provide a reciprocation compressor comprising an extraction passage connecting a crank chamber with an inlet chamber, an aperture disposed in the extraction passage and a filter capturing foreign matters flowing from the crank chamber to the inlet chamber, wherein the foreign matters captured by the filter is restrained from returning to the crank chamber even if reverse flow of refrigerant from the inlet chamber to the crank chamber is generated, and the filter does not restrict design specifications of other members of the compressor.

[Disclosure of the Invention] A reciprocation compressor comprises an extraction passage connecting a crank chamber with an inlet chamber, an aperture disposed in the extraction passage and a filter capturing foreign matters flowing from the crank chamber to the inlet chamber, and the filter is located downstream of the aperture in relation to the flow of the refrigerant in the extraction passage from the crank chamber to the inlet chamber, and the filter is disposed in the inlet chamber.

7 Claims, 4 Drawing Sheets

RECIPROCATION COMPRESSOR

This is a U.S. National Phase Application under 35 USC 371 of International Application PCT/JP2010/006813 filed on Nov. 19, 2010.

This application claims the priority of Japanese Application No. 2009-269470 filed Nov. 27, 2009, the entire content of which is hereby incorporated by reference.

TECHNICAL FIELD

The present invention relates to a reciprocation compressor used for a car air conditioner.

BACKGROUND ART

Patent Document 1 teaches a reciprocation compressor comprising a cylinder block provided with a plurality of cylinder bores, a plurality of pistons each disposed in one of the cylinder bores, a front housing closing one end of the cylinder block to cooperate with the cylinder block, thereby forming a crank chamber, a valve plate closing the other end of the cylinder block, a cylinder head opposing the cylinder block with the valve plate inserted between them to form in it an annular outlet chamber, an inlet chamber disposed radially inside the outlet chamber, an inlet passage connecting an inlet port with the inlet chamber and an outlet passage connecting an outlet port with the outlet chamber, a driving shaft disposed in a housing formed by the front housing, the cylinder block and the cylinder head and rotatably supported by the housing, a converter for converting rotational movement of the driving shaft to reciprocal movement of the pistons, an extraction passage between the crank chamber and the inlet chamber, and an aperture disposed in the extraction passage, wherein refrigerant gas is sucked into the cylinder bores from the inlet chamber, compressed in the cylinder bores, and discharged into the outlet chamber from the cylinder bores, and wherein a filter is located upstream of the aperture in relation to the flow of the refrigerant gas in the extraction passage directed to the inlet chamber from the crank chamber. In the reciprocation compressor of the Patent Document 1, foreign matters flowing from the crank chamber to the inlet chamber is captured by the filter.

PRIOR ART DOCUMENT

Patent Document

Patent Document 1: Japanese Patent Laid-Open Publication No. 2005-120972

DISCLOSURE OF INVENTION

Problem to be Solved

Drawbacks of the compressor of Patent Document 1 are as follows.

(1) The temperature of the evaporator of an air conditioner occasionally becomes higher than the temperature of the compressor when the compressor is stopped. In this case, pressure difference is generated in the refrigerant gas due to temperature difference in the refrigerant gas, the refrigerant gas flows from the evaporator of the air conditioner to the inlet chamber of the compressor, and the refrigerant gas further flows from the inlet chamber to the crank chamber through the aperture. When the compressor is stopped for a long time, the following risk arises: namely, the volume of refrigerant liquid gradually increases in the crank chamber, the refrigerant liquid surface rises beyond the level of the filter, foreign matters captured by the filter are drawn out of the filter by a slight flow of the refrigerant liquid from the inlet chamber to the crank chamber, and the foreign matters enter into bearings for the driving shaft disposed near the filter, the crank chamber, etc.

(2) The aperture is usually formed in a valve plate, an inlet valve forming member provided with inlet valves, or a cylinder gasket disposed between the cylinder block and the inlet valve forming member. When the filter is disposed upstream of the aperture, a space for accommodating the filter must be formed in the center portion of the cylinder block. As a result, other design specifications such as bearing arrangement, driving shaft length, etc. are restricted.

(3) Refrigerant gas sucked from the evaporator of the air conditioner and blowby gas flowing into the inlet chamber through the extraction passage is taken into the cylinder bores. Therefore, installation of a filter in the extraction passage is insufficient and installation of a filter for capturing foreign matters entrained by the refrigerant gas sucked from the evaporator is desirable in order to prevent the foreign matters from entering into the cylinder bores. However, installation of two filters causes problems from the viewpoints of installation space and cost performance.

Objects of the present invention are to provide, (1) A reciprocation compressor comprising a filter that is capable of preventing the foreign matters captured by the filter from entering into the crank chamber even if reverse flow of the refrigerant from the inlet chamber to the crank chamber is generated and that places no restriction on other design specifications.

(2) A reciprocation compressor comprising a filter that is capable of capturing the foreign matters entrained by both the blowby gas and the sucked refrigerant gas from the air conditioner and that causes no problem from the viewpoints of installation space and cost performance.

Means for Solving the Problem

In accordance with the present invention, there is provided a reciprocation compressor comprising a cylinder block provided with a plurality of cylinder bores, a plurality of pistons each disposed in one of the cylinder bores, a front housing closing one end of the cylinder block to cooperate with the cylinder block, thereby forming a crank chamber, a valve plate closing the other end of the cylinder block, a cylinder head opposing the cylinder block with the valve plate inserted between them to form in it an annular outlet chamber, an inlet chamber disposed radially inside the outlet chamber, an inlet passage connecting an inlet port with the inlet chamber and an outlet passage connecting an outlet port with the outlet chamber, a driving shaft disposed in a housing formed by the front housing, the cylinder block and the cylinder head and rotatably supported by the housing, a converter for converting rotational movement of the driving shaft to reciprocal movement of the pistons, an extraction passage between the crank chamber and the inlet chamber, and an aperture disposed in the extraction passage, wherein refrigerant gas is sucked into the cylinder bores from the inlet chamber, compressed in the cylinder bores, and discharged into the outlet chamber from the cylinder bores, and wherein a first filter is located downstream of the aperture in relation to the flow of the refrigerant gas in the extraction passage directed to the inlet chamber from the crank chamber, and the first filter is disposed in the inlet chamber.

Even if reverse flow of refrigerant from the inlet chamber to the crank chamber is caused and foreign matters captured by the first filter are drawn out of the first filter in the reciprocal compressor in accordance with the present invention, the foreign matters are restrained from entering into the crank chamber by the aperture disposed downstream of the first filter in relation to the reverse flow.

In the reciprocal compressor in accordance with the present invention, the first filter is disposed in the inlet chamber located radially inside the annular outlet chamber. Therefore, the first filter can be large sized so as to make the net of the first filter distant from the aperture. Therefore, even if reverse flow of refrigerant from the inlet chamber to the crank chamber is caused and foreign matters captured by the first filter are drawn out of the first filter, the foreign matters are restrained from approaching the aperture and also from entering into the crank chamber.

The first filter disposed in the inlet chamber located radially inside the annular outlet chamber does not restrict other design specifications.

In accordance with a preferred embodiment of the present invention, the reciprocation compressor further comprises an outlet-valve-forming member provided with outlet valves, a head gasket disposed between the outlet-valve-forming member and the cylinder head, an inlet-valve-forming member provided with inlet valves, and a cylinder gasket disposed between the inlet-valve-forming member and the cylinder block. The first filter comprises a case member provided with a first opening directed to the aperture and surrounded by a flange, and a second opening directed to the inlet chamber, and a net member covering the second opening. The flange is clamped by two members selected from the group consisting of the cylinder gasket, the inlet-valve-forming member, the valve plate, the outlet-valve-forming member and the head gasket.

When the first opening directed to the aperture is surrounded by the flange and the flange is clamped by two members selected from the group consisting of the cylinder gasket, the inlet-valve-forming member, the valve plate, the outlet-valve-forming member and the head gasket, the first filter can be reliably located and held on the compressor by existing members. No other new holding member is necessary in order to locate and hold the first filter on the compressor. The first filter clamped by the two members is safe from being easily detached from the compressor.

In accordance with another preferred embodiment of the present invention, the inlet passage leads refrigerant gas from the outside refrigerant circuit to the inlet chamber, a second filter is disposed in the inlet passage and at the inlet chamber side end of the inlet passage, and the first filter and the second filter are integrally united.

The first filter for capturing the foreign matters entrained by the refrigerant entering into the inlet chamber through the extraction passage is integrally united with the second filter for capturing the foreign matters entrained by the refrigerant entering into the inlet chamber through the inlet passage. The aforementioned integrated arrangement of the first and the second filters alleviates the problem of securing installation space for the filters, simplifies the structure of the compressor, and lowers the production cost of the compressor below that of the independently provided first and the second filters.

In accordance with another preferred embodiment of the present invention, the unitary body formed by the first filter and the second filter comprises a case member provided with a first opening directed to the aperture, a second opening directed to the inlet chamber and a third opening directed to the inlet chamber side end of the inlet passage, and a net member covering the second opening.

The united body of the first filter and the second filter formed by the case member and the net member can treat two refrigerant flows notwithstanding that the united body has almost the same structure as an ordinary filter.

In accordance with another preferred embodiment of the present invention, the compressor further comprises an outlet-valve-forming member provided with outlet valves, a head gasket disposed between the outlet-valve-forming member and the cylinder head, an inlet-valve-forming member provided with inlet valves, and a cylinder gasket disposed between the inlet-valve-forming member and the cylinder block, wherein the unitary body formed by the first filter and the second filter is held at one end provided with the first opening by one member selected from the group consisting of the cylinder gasket, the inlet-valve-forming member, the valve plate, the outlet-valve-forming member and the head gasket, and held by an end wall of the cylinder head forming the inlet chamber at the other end provided with the third opening.

When the unitary body formed by the first filter and the second filter is held at one end provided with the first opening by one member selected from the group consisting of the cylinder gasket, the inlet-valve-forming member, the valve plate, the outlet-valve-forming member and the head gasket, and held by the end wall of the cylinder head defining the inlet chamber at the other end provided with the third opening, the unitary body can be reliably held on the compressor by existing members. No other new holding member is necessary in order to hold the unitary body on the compressor. The unitary body can be stably held because it is held at both ends.

In accordance with another preferred embodiment of the present invention, the inlet chamber side end of the inlet passage opposes the aperture disposed in the extraction passage.

When the inlet chamber side end of the inlet passage opposes the aperture disposed in the extraction passage, the configuration of the unitary body formed by the first filter and the second filter can be simplified. Thus, production of the unitary body becomes easy.

In accordance with another preferred embodiment of the present invention, the central axis of the inlet chamber side end of the inlet passage and the central axis of the aperture disposed in the extraction passage are substantially aligned with the central axis of the driving shaft.

The aforementioned arrangement makes it possible to make the unitary body cylindrical so as to enable easy production of the unitary body. The aforementioned arrangement enables the central axis of the unitary body to be substantially aligned with the central axis of the driving shaft so as to prevent the height of the filter from the lowest part of the crank chamber from varying due to divergence of the installation angle of the compressor around the central axis of the driving shaft, thereby preventing the foreign matters capturing performance of the filter from varying due to variation in the height of the filter from the lowest part of the crank chamber.

MODES FOR CARRYING OUT THE INVENTION

Preferred embodiments of the present invention will be described.

Preferred Embodiment 1

Figure 1:
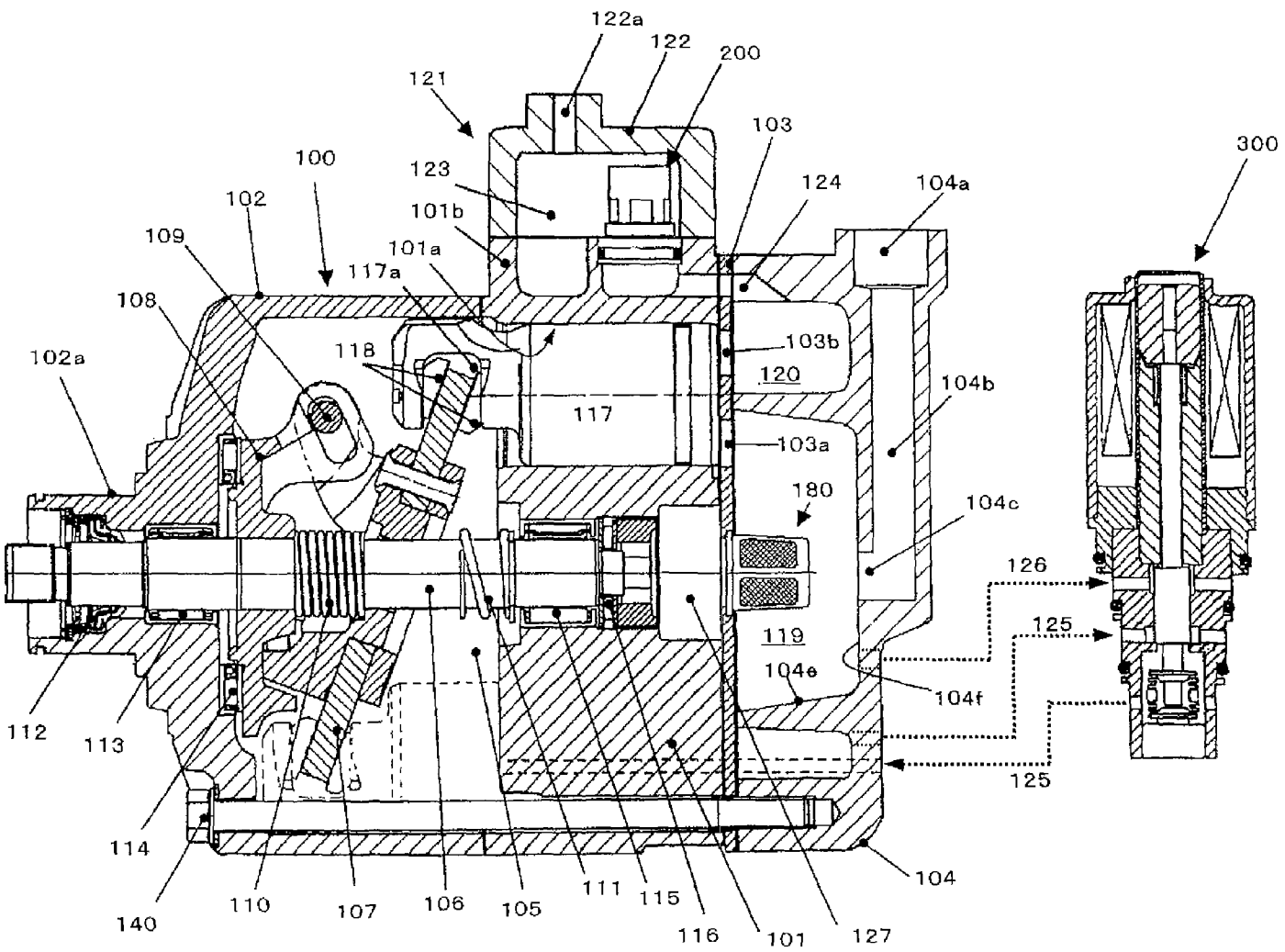
FIG. 1 is a side sectional view of a variable displacement swash plate compressor in accordance with a first preferred embodiment of the present invention.
Figure 2:
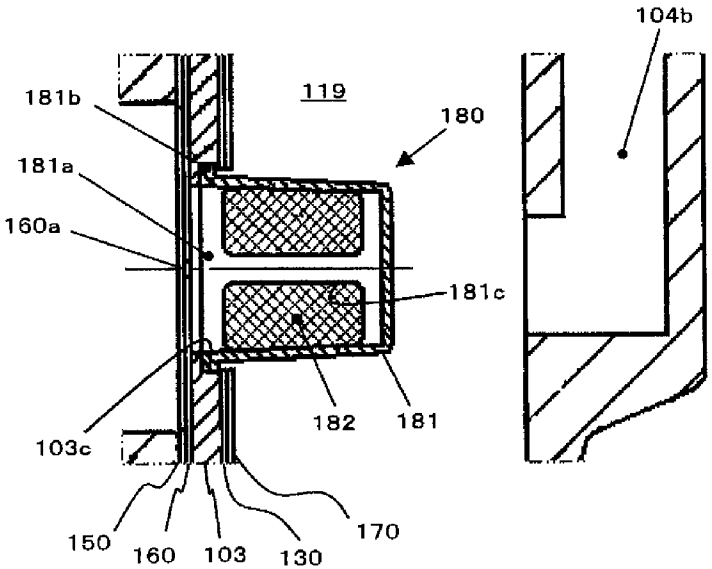
FIG. 2 is a partially enlarged view of FIG. 1 showing the filter and other members near the filter.

As shown in FIGS. 1 and 2, a variable displacement swash plate compressor 100 is provided with a cylinder block 101 having a plurality of cylinder bores 101*a*, a front housing 102 located at one end of the cylinder block 101, and a cylinder head 104 located at the other end of the cylinder block 101 with a valve plate 103 inserted between them.

A driving shaft 106 extends across a crank chamber 105 defined by the cylinder block 101 and the front housing 102. A swash plate 107 fits on the longitudinal middle of the driving shaft 106. The swash plate 107 is connected to a rotor 108 fixed to the driving shaft 106 through a connection member 109 to be variable in inclination relative to the driving shaft 106.

A coil spring 110 is disposed between the rotor 108 and the swash plate 107 to force the swash plate 107 in the direction of minimum inclination angle. A coil spring 111 is also provided. The coil springs 110 and 111 are disposed to face opposite surfaces of the swash plate 107. The coil spring 111 forces the swash plate 107 in the direction to increase the inclination angle of the swash plate 107.

The front housing 102 is provided with a boss 102*a* projecting outside the front housing 102. One end of the driving shaft 106 passes through the boss 102*a* to extend out of the boss, thereby being connected to a power transmission not shown in FIGS. 1 and 2. A seal member 112 is disposed between the driving shaft 106 and the boss 102*a* to shut the crank chamber 105 off from the environment. The driving shaft 106 is supported in the radial direction and the thrust direction by bearings 113, 114,115 and 116. The driving shaft 106 rotates synchronously with the power transmission to which power is transmitted from an external power source.

Pistons 117 are inserted into the cylinder bores 101*a*. Each piston 117 is provided with a concave 117*a* at one end. The concave 117*a* accommodates the outer periphery of the swash plate 107. The pistons 117 operatively engage the swash plate 107 through shoes 118. Thus, rotation of the driving shaft 106 is converted to reciprocal movement of the pistons 117 and the pistons 117 reciprocate in the cylinder bores 101*a*.

The cylinder head 104 is provided with an inlet chamber 119 and an outlet chamber 120. The inlet chamber 119 communicates with the cylinder bores 101*a* through communication holes 103*a* formed in the valve plate 103 and inlet valves formed in an inlet-valve-forming member 160. The inlet valves are not shown in FIGS. 1 and 2. The outlet chamber 120 communicates with the cylinder bores 101*a* through outlet valves formed in an outlet-valve-forming member 130 and communication holes 103*b* formed in the valve plate 103. The outlet valves are not shown in FIGS. 1 and 2.

The outlet chamber 120 has an annular form and the inlet chamber 119 is disposed radially inside the outlet chamber 120. The inlet chamber 119 forms a substantially cylindrical space coaxial with the driving shaft 106 surrounded by a substantially annular first wall 104*e* forming a boundary wall between the inlet chamber 119 and the outlet chamber 120 and a second wall 104*f* closing one end of the first wall 104*e*.

The front housing 102, a center gasket, the cylinder block 101, a cylinder gasket 150, the inlet-valve-forming member 160, the valve plate 103, the outlet-valve-forming member 130, a head gasket 170, and the cylinder head 104 are connected with each other by a plurality of through bolts 140 to form a compressor housing.

The cylinder block 101 is provided with a muffler 121. The muffler 121 is formed by an annular wall 101*b* formed on the outer surface of the cylinder block 101 and a cover 122 connected to the annular wall 101*b* with a seal member inserted between them. The seal member is not shown in FIGS. 1 and 2. A check valve 200 is installed in a muffler space 123. The check valve 200 is located at the connection between the muffler space 123 and an outlet passage 124. The check valve 200 operates in response to the pressure difference between the internal pressure of the outlet passage 124 upstream of the check valve 200 and the internal pressure of the muffler space 123 downstream of the check valve 200. The check valve 200 closes the outlet passage 124 when the pressure difference is smaller than a predetermined level and opens the outlet passage 124 when the pressure difference is larger than the predetermined level. The outlet chamber 120 is connected to a high-pressure side external refrigerant circuit of an air conditioner through the outlet passage 124, the check valve 200, the muffler space 123 and an outlet port 122*a*.

The cylinder head 104 is provided with an inlet port 104*a* connecting with a low-pressure side refrigerant circuit of the air conditioner. The inlet port 104*a* is connected to the inlet chamber 119 through an inlet passage 104*b* and the inlet chamber side end 104*c* of the inlet passage 104*b*.

The cylinder head 104 is further provided with a displacement control valve 300. The displacement control valve 300 controls the aperture of an air supply passage 125 extending between the outlet chamber 120 and the crank chamber 105 to control the flow rate of the discharging refrigerant gas led into the crank chamber 105. The refrigerant gas in the crank chamber 105 is led into the inlet chamber 119 through an extraction passage 127 extending through spaces between the bearings 115, 116 and the driving shaft 106, a communication hole formed in the cylinder gasket 150, a fixed orifice, i.e., an aperture 160*a* formed in the inlet-valve-forming member 160, a communication hole formed in the valve plate 103 and a filter 180 disposed in the inlet chamber 119 downstream of the fixed orifice 160*a*. The communication holes formed in the cylinder gasket 150 and the valve plate 103 are not shown in FIGS. 1 and 2. Foreign matters entrained by the refrigerant gas flowing in the extraction passage 127 are captured by the filter 180.

The fixed orifice 160*a* defines the minimum sectional area of the extraction passage 127. The diameter of the fixed orifice 160*a* is set at the necessary and sufficient minimum level for discharging blowby gas leaked out of the cylinder bores into the crank chamber 105 when the pistons 17 compress the refrigerant gas. For example, the diameter of the fixed orifice is set at 1.5 mm to 1.8 mm in a variable displacement swash plate compressor using R134a refrigerant gas.

The displacement control valve 300 can control the flow rate of the discharging refrigerant gas led into the crank chamber 105 to control the internal pressure of the crank chamber 105, thereby controlling the inclination angle of the swash plate 7, the stroke of the pistons 117, and the displacement of the variable displacement swash plate compressor 100. The displacement control valve 300 is an externally controlled displacement control valve operating in response to external control signals. The displacement control valve 300 detects the internal pressure of the inlet chamber 119 through a communication passage 126. The displacement of the compressor 100 can be controlled by controlling the supply of electric current to a solenoid of the displacement control valve 300 so as to control the internal pressure of the inlet chamber 119 to a predetermined level. When the supply of electric current to the solenoid is stopped, the displacement control valve 300 forces a valve body thereof to open, thereby minimizing the displacement of the compressor 100.

The filter 180 comprises a case member 181 of cylindrical shape closed at one end provided with a first opening 181*a* directed to the fixed orifice 160*a* and surrounded by a flange 181*b*, and a plurality of second openings 181*c* directed to the inlet chamber 119, and a net member 182 covering the second openings 181*c*. Total opening area of the second openings 181*c* and mesh size of the net member 182 are set at a level suitable for the size of foreign matters to be captured. The case member 181 and the net member 182 are made of resin material.

The flange 181*b* is fitted in a concave 103*c* formed in the valve plate 103. The end face of the flange 181*b* opposing the inlet chamber 119 slightly projects toward the inlet chamber 119 from the end face of the valve plate 103. The outlet-valve-forming member 130 and the head gasket 170 are provided with insert holes of substantially the same diameter through which the cylindrical portion of the case 181 passes. The diameter of the insert holes is set at a level smaller than the outer diameter of the flange 181*b*. One of the end faces of the outlet-valve-forming member 130 abuts the end face of the flange 181*b* opposing the inlet chamber 119 at a portion surrounding the insert hole. When the aforementioned members for constituting the housing are assembled as a unitary body by the plurality of through bolts 140, the outlet-valve-forming member 130 is forced by the end face of the first wall 104*e* of the cylinder head 104 and the end faces of forcing legs provided in the inlet chamber 119 and not shown in FIGS. 1 and 2 at the portion distant from the flange 181*b*, and the end face of the flange 181*b* opposing the inlet chamber 119 is forced by the portion of the one end face of the outlet-valve-forming member 130 surrounding the insert hole therein. The flange 181*b* is forced toward the valve plate 103 by the outlet-valve-forming member 130 made of spring steel to be clamped by the valve plate 103 and the outlet-valve-forming member 130. As a result, the filter 180 is held by the valve plate 103 and the outlet-valve-forming member 130.

Even if reverse flow of refrigerant from the inlet chamber 119 to the crank chamber 105 is generated and foreign matters captured by the filter 180 are drawn out of the filter 180, the foreign matters are restrained from entering into the crank chamber 105 by the fixed orifice 160*a* defining the minimum aperture between the crank chamber 105 and the internal space of the filter 180. The filter 180 is disposed in the inlet chamber 119 of cylindrical shape disposed radially inside the outlet chamber 120 of annular shape. Therefore, the filter 180 can be large sized so as to make the net member 182 capturing the foreign matters distant from the fixed orifice 160*a*, thereby restraining the foreign matters from approaching the fixed orifice 160*a* and also entering into the crank chamber 105.

The filter 180 disposed in the inlet chamber 119 of cylindrical form does not restrict other design specifications. The flange 181*b* is clamped by two existing members, i.e., the valve plate 103 and the outlet-valve-forming member 130. Therefore, no other new holding member is necessary in order to locate and hold the one end of the filter 180 on the compressor 100. The filter 180 clamped by the two members cannot easily fall off.

Figure 3:
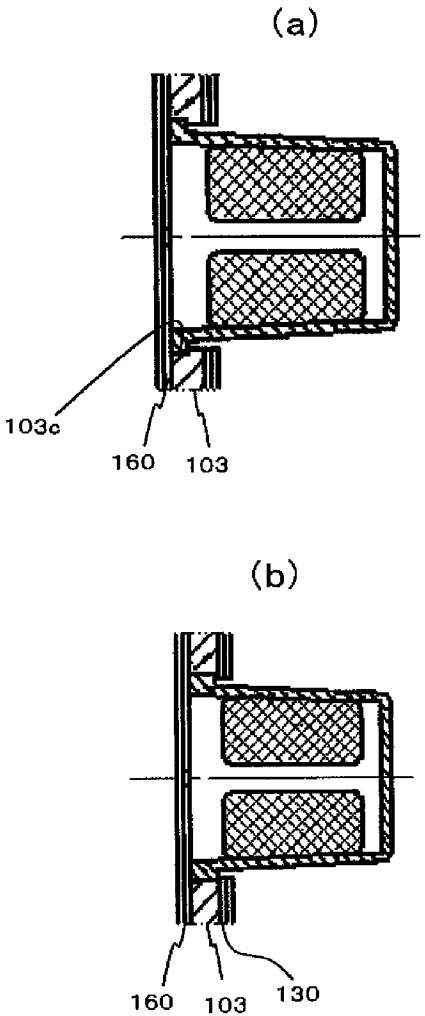
FIG. 3 is a set of views showing various ways for holding the flange of the filter of FIG. 2.

Various methods for clamping the flange 181*b* can be conceived. For example, the flange 181*b* can be clamped by the valve plate 103 and the inlet-valve-forming member 160 as shown in FIG. 3 (*a*), or the flange 181*b* can be clamped by the outlet-valve-forming member 130 and the inlet-valve-forming member 160 as shown in FIG. 3 (*b*). Still other methods are conceivable, if the cylinder gasket 150 and the head gasket 170 are taken into account.

Second Preferred Embodiment

Figure 4:
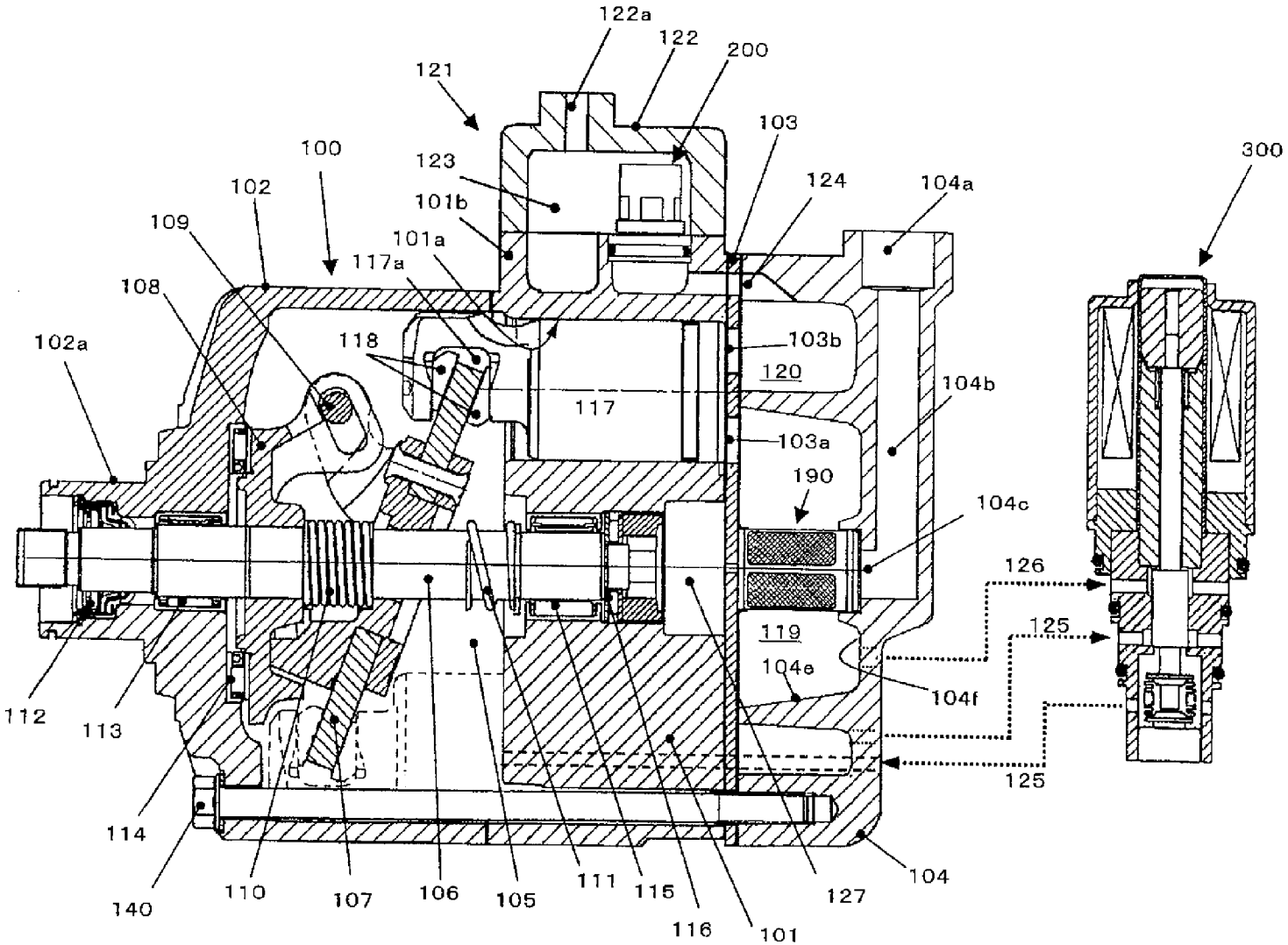
FIG. 4 is a side sectional view of a variable displacement swash plate compressor in accordance with a second preferred embodiment of the present invention.

As shown in FIG. 4, the structure of the compressor 100 is basically the same as that in FIG. 1 except that a filter 190 is installed instead of the filter 180. The central axis of the fixed orifice 160*a* and the central axis of the inlet chamber side end 104*c* of the inlet passage 104*b* are substantially aligned with the central axis of the driving shaft 106.

Figure 5:
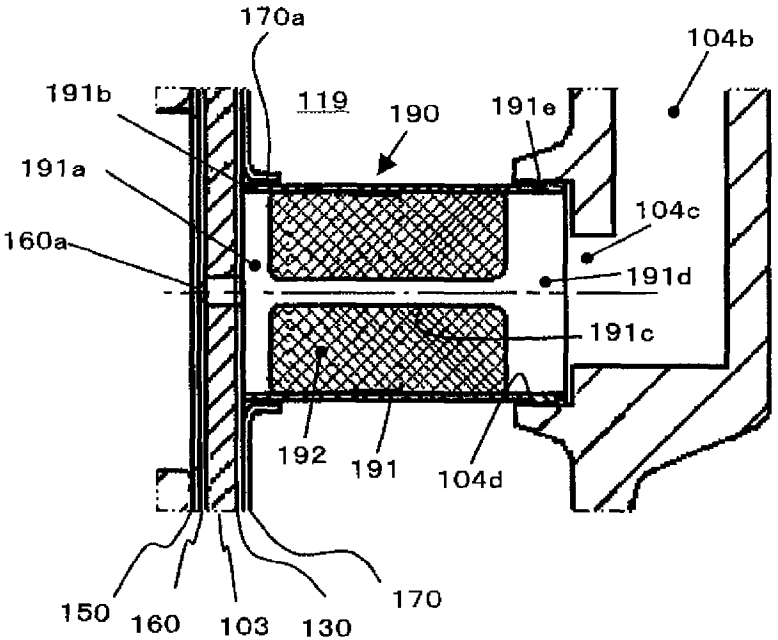
FIG. 5 is a partially enlarged view of FIG. 4 showing the filter and other members near the filter.

As shown in FIG. 5, the filter 190 is constituted by a cylindrical case 191 provided with one end 191*b* having a first opening 191*a* directed to the fixed orifice 160*a*, a plurality of second openings 191*c* directed to the inlet chamber 119, and the other end 191*e* having a third opening 191*d* directed to the inlet chamber side end 104*c* of the inlet passage 104*b*, and a net member 192 covering the second openings 191*c*. The total opening area of the second openings 191*c* and mesh size of the net member 192 are set at a level suitable for the size of the foreign matters to be captured. The case 191 and the net member 192 are made of resin material.

The one end 191*b* of the case 191 abuts the outlet-valve-forming member 130, the head gasket 170 is provided with an insert hole through which the cylindrical portion of the case 191 passes, the insert hole is surrounded by a drum 170*a* formed by the portion of the head gasket 170 surrounding the insert hole bent toward the inlet chamber 119 by press molding, and the one end 191*b* of the case 191 is fitted in and held by the drum 170*a*. The other end 191*e* of the case 191 is fitted in and held by a concave 104*d* formed around the inlet chamber side end 104*c* of the inlet passage 104*b*.

The filter 190 can capture not only the foreign matters entrained by the refrigerant flowing into the inlet chamber 119 through the inlet passage 104*b* but also the foreign matters entrained by the refrigerant flowing into the inlet chamber 119 through the extraction passage 127. The filter 190 is disposed in the inlet chamber 119 of cylindrical form located radially inside the outlet chamber 120 of annular form. Therefore, the size of the filter 190 can be increased, and variation of the total opening area and mesh size of the filter increases.

A filter for capturing the foreign matters entrained by the refrigerant entering into the inlet chamber 119 through the extraction passage 127 is integrally united with a filter for capturing the foreign matters entrained by the refrigerant entering into the inlet chamber 119 through the inlet passage 104*b*. The aforementioned integrated arrangement of the two filters can alleviates the problem of securing installation space for the filters, simplifies the structure of the compressor 100, and lowers the production cost of the compressor 100 below that of independently arrangement of the two filters.

The filter 190 is constituted by the case 191 and the net member 192. Therefore, the filter 190 can respond to two independent flows even though its structure is equivalent to that of the ordinary filter.

The one end 191*b* provided with the opening 191*a* is held by the head gasket 170 and the other end 191*e* provided with the opening 191*d* is held by the end wall of the cylinder head 104 forming the inlet chamber 119. Thus, the filter 190 is held by existing members of the compressor 100. No other new holding member is necessary in order to hold the filter 190. The filter 190 can be stably held because it is held at both ends.

The inlet chamber side end 104*c* of the inlet passage 104*b* opposes the fixed orifice 160. Therefore, the filter 190 can be of simple cylindrical shape so as to be made easily.

The central axis of the inlet chamber side end 104*c* of the inlet passage 104*b* and the central axis of the fixed orifice 160*a* are substantially aligned with the central axis of the driving shaft 106. The aforementioned arrangement makes it possible to prevent the height of the filter 190 from the lowest part of the crank chamber 105 from varying due to the divergence of the installation angle of the compressor 100 around the central axis of the driving shaft 106, thereby preventing the foreign matters capturing performance of the filter 190 from varying due to the variation in the height of the filter 190 from the lowest part of the crank chamber 105.

In FIG. 5, the one end 191*b* of the case 191 is held by the drum 170*a* of the head gasket 170. The same kind of holding structure can be formed in anyone of the outlet-valve-forming member 130, the valve plate 103, the inlet-valve-forming member 160, or the cylinder gasket 150. When the cylinder gasket 150 is provided with the holding structure, the fixed orifice must be located more close to the crank chamber 105 than the cylinder gasket 150.

The one end 191*b* can be provided with a flange to be held in the same manner as that in FIG. 2. Thus, the filter can be reliably located on and held by the compressor at one end.

O-rings can be disposed between the outer circumferential surface of the one end 191*b* and the inner circumferential surface of the drum 170*a*, and between the outer circumferential surface of the other end 191*e* and the inner circumferential surface of the concave 104*d*. In this arrangement, refrigerant entering into the inlet chamber 119 reliably passes through the filter 190 and resiliency of the O-rings reliably prevent backlash of the filter.

Figure 6:
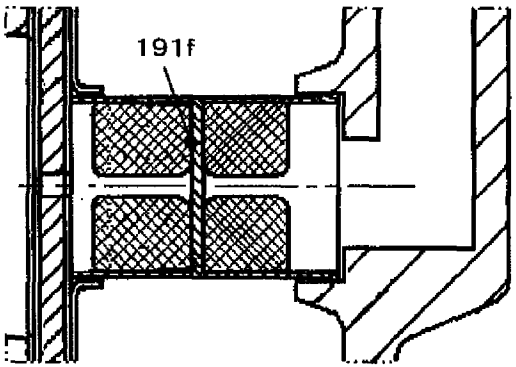
FIG. 6 is a view showing a variation of the filter of FIG. 5.

As shown in FIG. 6, it is possible to dispose a bulkhead 191*f*, thereby dividing the internal space of the filter 190 into a first subspace close to the inlet passage 104*b* and a second subspace close to the extraction passage 127 and dividing the second openings 191*c* into first sub openings close to the inlet passage 104*b* and second sub openings close to the extraction passage 127, and make the mesh size of the net member covering the first sub openings different from the mesh size of the net member covering the second sub openings. Such arrangement enables the size of the foreign matters to be captured entrained by the refrigerant entering into the inlet chamber 119 from the inlet passage 104*b* to be set at a level different from that of the size of the foreign matters to be captured entrained by the refrigerant entering into the inlet chamber 119 from extraction passage 127.

Third Preferred Embodiment

The aperture disposed in the extraction passage can be a variable flow rate aperture or a valve instead of the fixed orifice. The fixed orifice can be formed in the valve plate, the cylinder gasket, etc. A member for forming an orifice can be disposed in the extraction passage.

The present invention can be used for various kinds of compressors such as fixed displacement swash plate compressors, wobble plate compressors, compressors provided with clutches, clutchless compressors, etc.

The present invention can be used for variable displacement compressors using new type refrigerant instead of R134a refrigerant.

INDUSTRIAL APPLICABILITY

The present invention can be widely applied to reciprocation compressors used in car air conditioners.

BRIEF DESCRIPTION OF THE REFERENCE NUMERALS

100 Variable displacement swash plate compressor
101 Cylinder block
102 Front housing
103 Valve plate
104 Cylinder head
104*b* Inlet passage
119 Inlet chamber
160*a* fixed orifice
180, 190 filter

The invention claimed is:

1. A reciprocation compressor comprising a cylinder block provided with a plurality of cylinder bores, a plurality of pistons each disposed in one of the cylinder bores, a front housing closing one end of the cylinder block to cooperate with the cylinder block, thereby forming a crank chamber, a valve plate closing the other end of the cylinder block, a cylinder head opposing the cylinder block with the valve plate inserted between them to form in it an annular outlet chamber, an inlet chamber disposed radially inside the outlet chamber, an inlet passage connecting an inlet port with the inlet chamber and an outlet passage connecting an outlet port with the outlet chamber, a driving shaft disposed in a housing formed by the front housing, the cylinder block and the cylinder head and rotatably supported by the housing, a converter for converting rotational movement of the driving shaft to reciprocal movement of the pistons, an extraction passage between the crank chamber and the inlet chamber, and an aperture disposed in the extraction passage, wherein refrigerant gas is sucked into the cylinder bores from the inlet chamber, compressed in the cylinder bores, and discharged into the outlet chamber from the cylinder bores, and wherein a first filter is located downstream of the aperture in relation to the flow of the refrigerant gas in the extraction passage directed to the inlet chamber from the crank chamber, and the first filter is disposed in the inlet chamber.

2. A reciprocation compressor of claim 1, further comprising an outlet-valve-forming member provided with outlet valves, a head gasket disposed between the outlet-valve-forming member and the cylinder head, an inlet-valve-forming member provided with inlet valves, and a cylinder gasket disposed between the inlet-valve-forming member and the cylinder block, wherein the first filter comprises a case member provided with a first opening directed to the aperture and surrounded by a flange, and a second opening directed to the inlet chamber, and a net member covering the second opening, and wherein the flange is clamped by two members selected from the group consisting of the cylinder gasket, the inlet-valve-forming member, the valve plate, the outlet-valve-forming member, and the head gasket.

3. A reciprocation compressor of claim 1, wherein the inlet passage leads refrigerant gas from an outside refrigerant circuit to the inlet chamber, a second filter is disposed in the inlet passage and at the inlet chamber side end of the inlet passage, and the first filter and the second filter are integrally united.

4. A reciprocation compressor of claim 3, wherein the unitary body formed by the first filter and the second filter comprises a case member provided with a first opening directed to the aperture, a second opening directed to the inlet chamber and a third opening directed to the inlet chamber side end of the inlet passage, and a net member covering the second opening.

5. A reciprocation compressor of claim 4, further comprising an outlet-valve-forming member provided with outlet valves, a head gasket disposed between the outlet-valve-forming member and the cylinder head, an inlet-valve-forming member provided with inlet valves, and a cylinder gasket disposed between the inlet-valve-forming member and the cylinder block, wherein the unitary body formed by the first filter and the second filter is held at one end provided with the first opening by one member selected from the group consisting of the cylinder gasket, the inlet-valve-forming member, the valve plate, the outlet-valve-forming member and the head gasket, and held by an end wall of the cylinder head forming the inlet chamber at the other end provided with the third opening.

6. A reciprocation compressor of claim 3, wherein the inlet chamber side end of the inlet passage opposes the aperture disposed in the extraction passage.

7. A reciprocation compressor of claim 6, wherein the central axis of the inlet chamber side end of the inlet passage and the central axis of the aperture disposed in the extraction passage are substantially aligned with the central axis of the driving shaft.

* * * * *